US006033092A

United States Patent [19]

Simon

[11] Patent Number: 6,033,092

[45] Date of Patent: Mar. 7, 2000

[54] REFRACTIVE-REFLECTIVE LIGHTING JACKET WITH FLUTED SEGMENTS AND SURROUNDING A LINEAL BULB LIGHT SOURCE IN A LONGITUDINAL DIRECTION

[76] Inventor: Jerome J. Simon, c/o Architectural Arts, Inc., 70 Sumner St., Newton Centre, Mass. 02159

[21] Appl. No.: 08/803,797

[22] Filed: Feb. 24, 1997

Related U.S. Application Data

[60] Provisional application No. 60/012,135, Feb. 23, 1996.

[51] Int. Cl.[7] ..... F21V 7/00

[52] U.S. Cl. ..... 362/298; 362/223; 362/224; 362/225; 362/219; 362/348; 362/328; 362/332; 362/309; 362/297; 362/260; 362/327

[58] Field of Search ..... 362/223, 224, 362/225, 219, 348, 328, 332, 309, 297, 260, 327

[56] References Cited

U.S. PATENT DOCUMENTS

| | | | |
|---|---|---|---|
| 2,356,654 | 8/1944 | Cullman | 362/327 |
| 3,701,896 | 10/1972 | Pate | 362/224 |
| 4,422,133 | 12/1983 | Elmer | 362/223 |
| 4,459,643 | 7/1984 | Mori | 362/224 |
| 4,779,178 | 10/1988 | Spitz | 362/260 |
| 4,858,088 | 8/1989 | Agabekov | 362/223 |
| 4,876,633 | 10/1989 | Engel | 362/223 |
| 5,658,066 | 8/1997 | Hirsch | 362/225 |

*Primary Examiner*—Sandra O'Shea
*Assistant Examiner*—Ronald E. Delgizzi
*Attorney, Agent, or Firm*—Perkins, Smith & Cohen; Jerry Cohen; Harvey Kaye

[57] ABSTRACT

A reflective-refractive lighting jacket has a first reflective and second refractive surface for surrounding a tubular light source in the interior of the jacket. A first reflective section reflects light from the source, and a second refractive section transmits light from the source and from the reflecting section. Both sections are forms in cross section that have a focal point in the interior of the jacket. Flutes in the jacket create various images and projected beams so that many different images and projected lines of the source are formed to provide for distributing light while minimizing actual diffusion.

13 Claims, 8 Drawing Sheets

REFRACTIVE-REFLECTIVE LIGHTING JACKET WITH FLUTED SEGMENTS AND SURROUNDING A LINEAL BULB LIGHT SOURCE IN A LONGITUDINAL DIRECTION

CROSS-REFERENCE TO RELATED APPLICATIONS

The present application is based upon provisional application No. 60/012,135 filed Feb. 23, 1996.

BACKGROUND OF THE INVENTION

1. Field of the Invention

This invention relates generally to lighting fixtures, and, more particularly, to a device for visually altering the shape, direction, and perceived sense of light sources contained therein.

2. Description of the Prior Art

U.S. Pat. No. 2,356,654 relates to an optical system using refraction and reflection to convert the light into a concentrated beam of light.

U.S. Pat. No. 3,701,896 relates to a luminarie for area lighting which includes a reflector and a refractor.

U.S. Pat. No. 4,422,133 relates to a luminaire having a reflector for providing two beams in opposite directions.

U.S. Pat. No. 4,459,643 relates to an artificial light source using lenses and photo-conducting cables to provide light from the source to another location.

U.S. Pat. No. 4,876,633 relates to a lighting unit having reflectors for generating light band type of lighting.

U.S. Pat. No. 4,858,088 relates to an elongated lighting device which includes a ribbed glass over the light source.

U.S. Pat. No. 5,658,066 relates to a continuous row lighting assembly joined together with end panels.

BRIEF SUMMARY OF THE INVENTION

The present invention provides a reflective-refractive lighting jacket which has a first reflective and second refractive surface for surrounding a tubular light source in the interior of the jacket. A first reflective section reflects light from the source, and a second refractive section transmits light from the source and from the reflecting section. Both sections are forms in cross section that have a focal point in the interior of the jacket. Flutes in the jacket create various images and projected beams so that many different images and projected lines of the source are formed to provide for distributing light while minimizing actual diffusion.

DETAILED DESCRIPTION OF THE PREFERRED EMBODIMENTS

Figure 1:
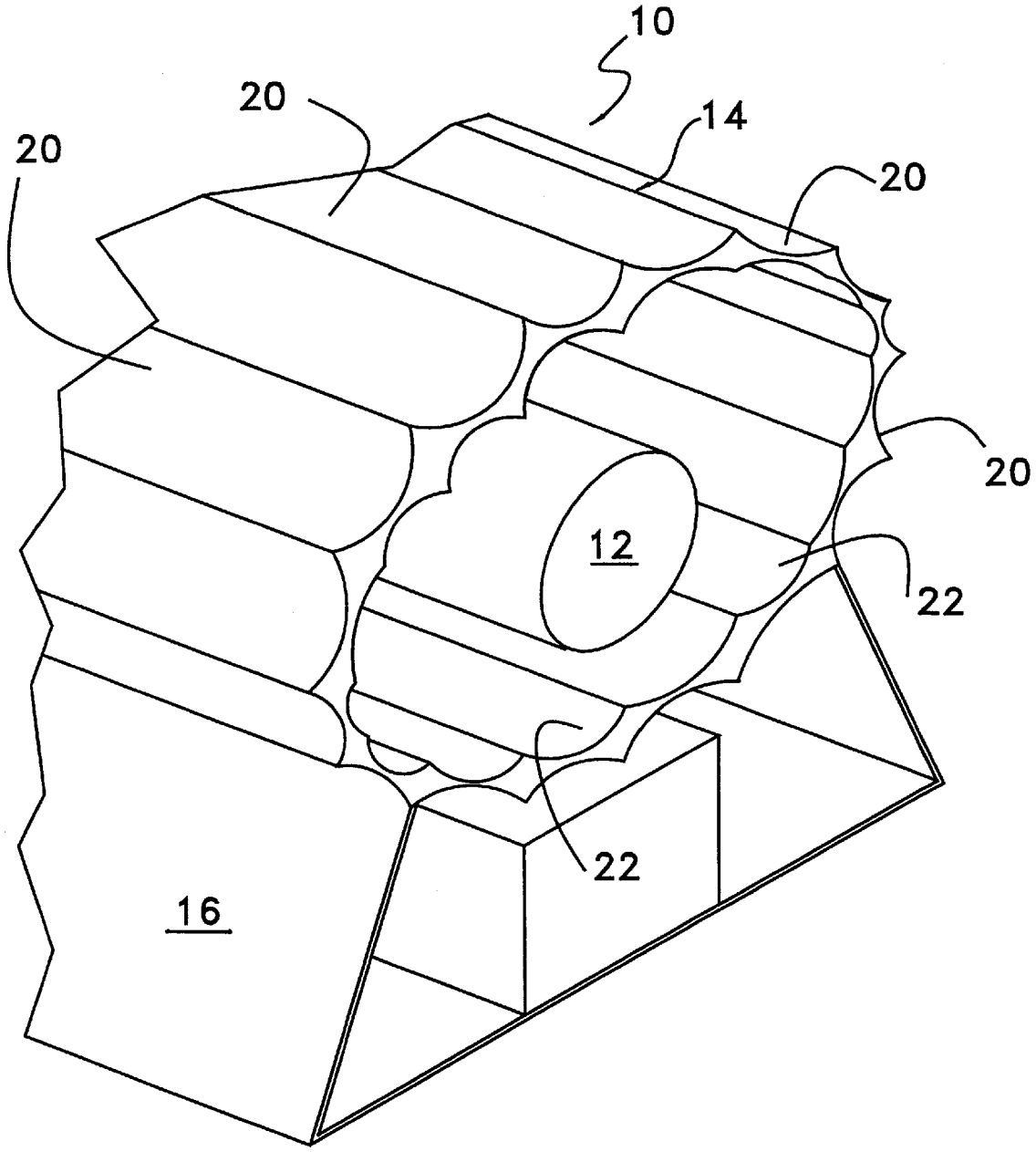
FIG. 1 is a pictorial representation of the refractive-reflective lighting jacket of this invention.

Reference is now made to FIG. 1 of the drawings which illustrates the lighting jacket 10 of the present invention. More specifically, jacket 10 encompasses a conventional light source 12 in the form of a linear fluorescent or neon bulb and is made up of a uniquely designed outer casing 14 mounted on a base 16 and having a pair of end caps 18 (one of which is being shown in FIG. 6). The internal and external design of casing 14 are configured in such a manner as to permit the refractive surface to be used as a refractive surface or, with vapor depositing a metallic surface thereon, a reflective surface. Thus effecting the refractive or reflective distribution of light from source 12 in order to create a series of light patterns camouflaging or reshaping the actual source of light 12.

Figure 2:
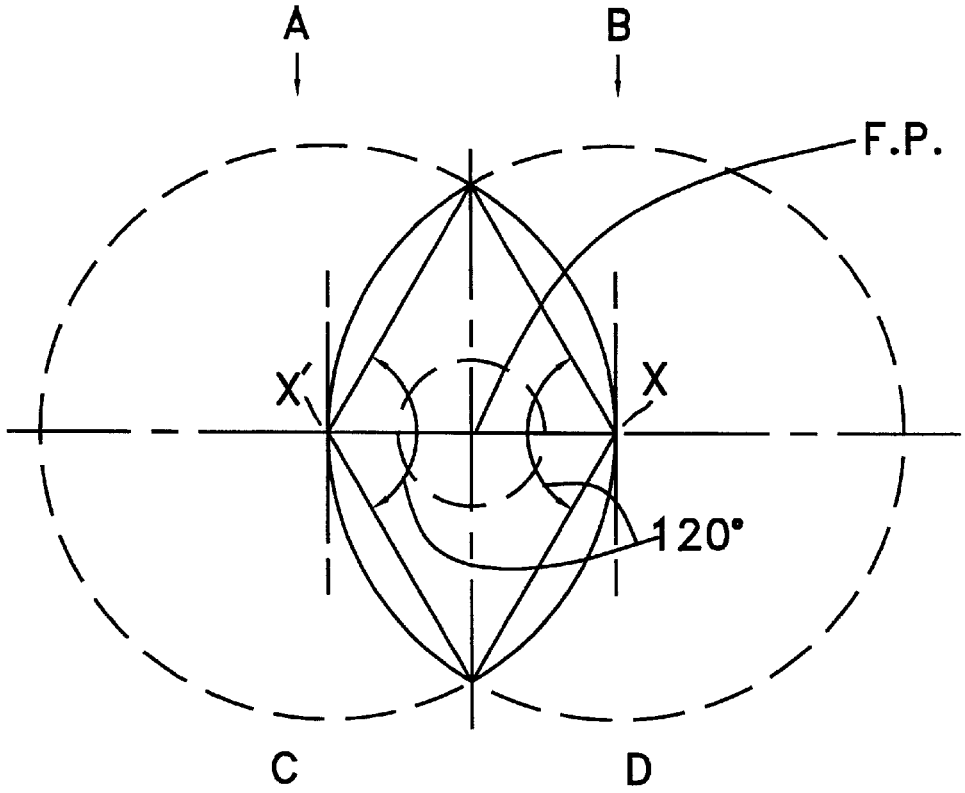
FIG. 2 is a schematic illustration of the optical geometry of the beginning stages in the design of the lighting jacket of this invention.
Figure 3:
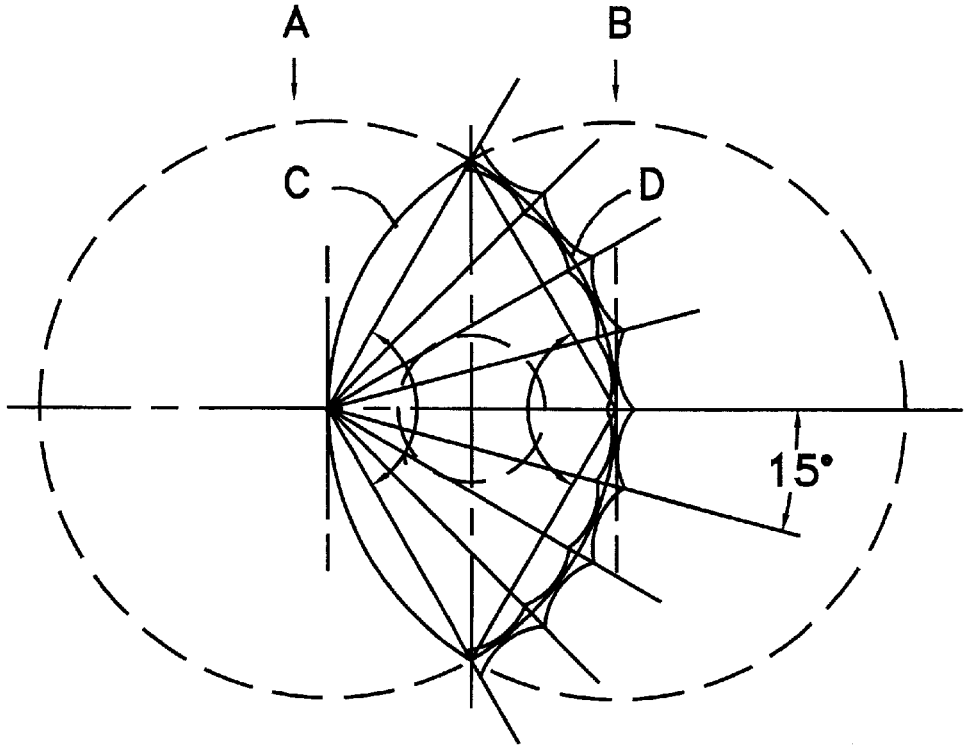
FIG. 3 is a schematic illustration of the formation of refracting and reflecting elements from the optical geometry of the completed design of the lighting jacket of this invention.

Casing 14 is designed in the manner illustrated in FIGS. 2 and 3 of the drawings. As shown in FIG. 2, a pair of overlapping circles A and B are created with the circumference of circle A lying at the center X of circle B and the circumference of circle B lying at the center X' of circle A. The focal point FP lies half way along the radii of circles A and B. This focal point is the center of light source 12. Surfaces C and D which are formed by portions by proportioning the circumferences of circles A and B as shown in FIG. 2 established the location of casing 14 of jacket 10 with respect to light source 12.

Figure 4:
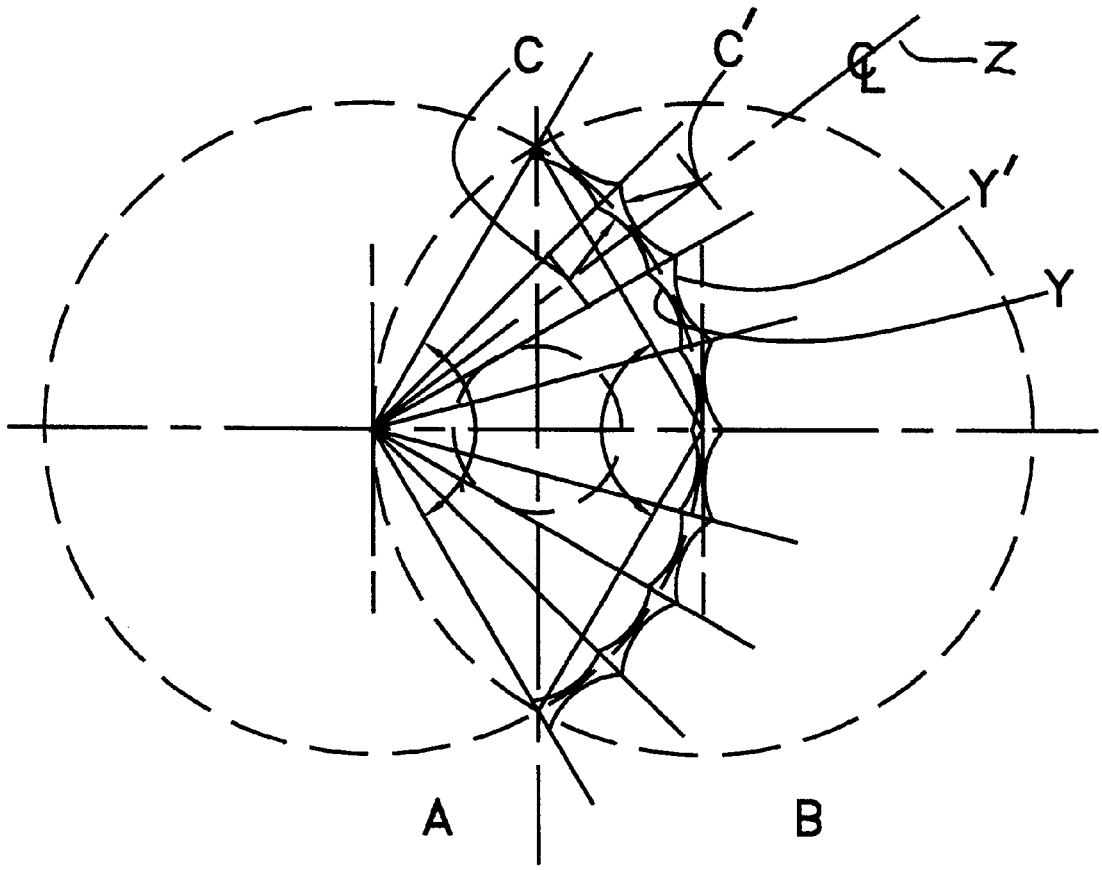
FIG. 4 is a schematic illustration of the formation of the concave flutes of the lighting jacket of this invention.

Reference is now made to FIG. 4 of the drawings to illustrate the formation of the maximum concave inner and outer flutes The center C and C' of the radius of the inner and outer concave flutes, respectively, lie along a line Z which bisects the flutes. The radius of the opposing inner and outer flutes are minimal so as to maximize their negative focal length, yet not so minimal as to have the distance between points Y and Y' be too large for standard extrusion techniques.

Based upon the above, FIGS. 1 and 5–7 provide details with respect to the specific configurations of the preferred embodiment of casing 14. Reference to these Figures will be made during the continued description of the present invention set forth below.

Referring once again to FIG. 1, casing 14 is made of a clear or translucent plastic or glass material of longitudinal cylindrical configuration surrounding light source 12. Its basic shape is configured based upon the analysis provided above with respect to FIG. 2. Casing 14 has longitudinally extending flutes 20 on the exterior surface thereof and longitudinally extending flutes 22 on the interior thereof, with its cylindrical/concave surface being at a maximum. In other words the flutes have a maximum concavity within the confines of casing 14. As will be explained in greater detail below, the interior of a portion 22 of casing 14 has portions thereof reflective while the remaining portions are refractive. The reflective portions may be created by vacuum depositing a metallic surface on the interior or exterior of refractive casing 14.

This refractive/reflective configuration creates the illusion of disguising the light source and produces a series of lines or other patterns of light emanating from the surface of casing 14. Secondary reflections from a reflective plate 24 within end caps 18 (shown in FIG. 6) creates the further illusion that source 12 extends beyond the end of the casing 14 or fixture. Any conventional extrusion technique can be utilized to create the maximum concavity of casing 14 which has been designed for conventional extrusion techniques.

Figure 6:
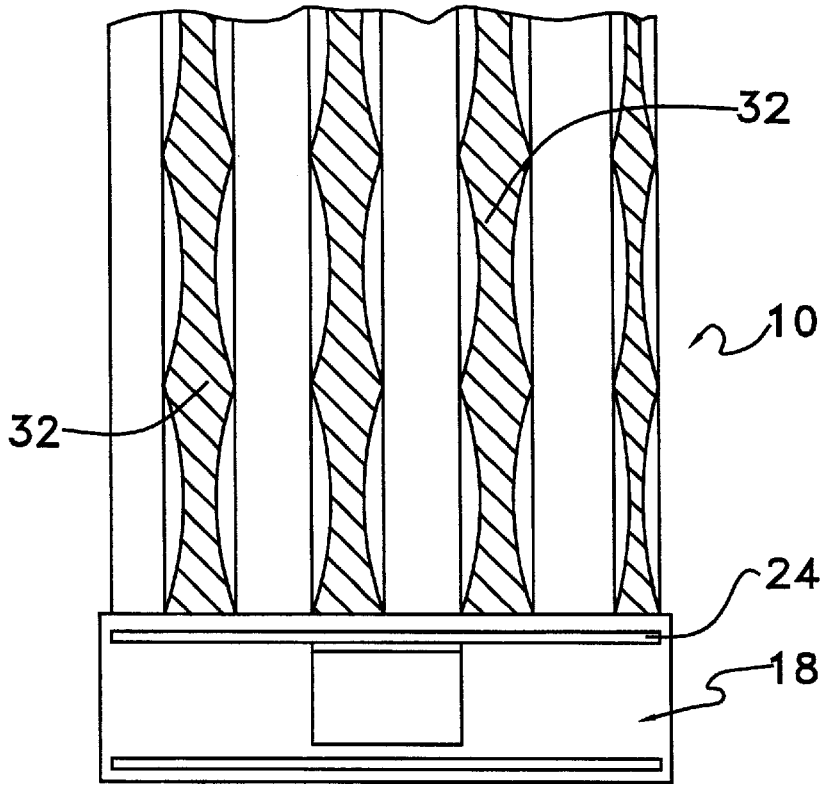
FIG. 6 is a plan view of the lighting jacket of FIG. 3 having the end cap in place and illustrating patterned reflecting surfaces.
Figure 5A:
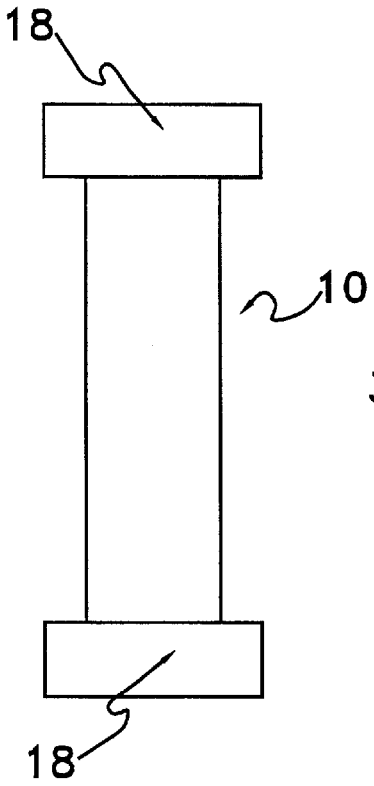
FIG. 5A is a schematic elevation of a complete jacket with the end caps attached to the ends.
Figure 5:
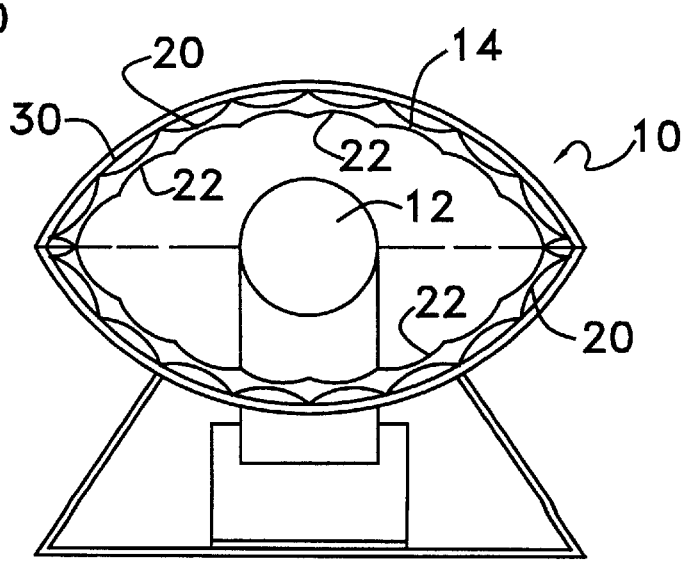
FIG. 5 is an end view of the refractive-reflecting lighting jack of this invention with the end cap removed.

As more clearly illustrated in FIGS. 5 and 6 of the drawings, the cylindrical jacket 10 is made up of a cylindrical casing 14 having a series of longitudinally extending external flutes 20 and internal flutes 22, both of maximum concavity. As shown in FIGS. 3 and 4, the concave surfaces which lie on surface D are equivalent to arc segments of circle A, while those on surface C (not shown in the Figure) are arc segments of circle B and could further be considered the base of an isosceles triangle whose vertices lie at the center of circles A and B, respectively. Although not limited thereto, the arc segment angles could be approximately 15 degrees each.

Referring once again to FIG. 5, an end cap cover 30 (shown in cross section) surrounds casing 14. As stated above, the reflective end cap 18 is illustrated in FIG. 6. This end cap 18 may be transparent or translucent, with a portion thereof overlapping light source 12. There are surfaces contained within end cap 8 (further described hereinbelow) to collect the light from source 12 and become luminous, thus creating the illusion that the light source extends to the end of the fixture.

As shown in FIG. 6, casing 14 may have a portion 32 reflective, while the remaining portions remain refractive. This combination of refractivity and reflectivity in predetermined patterns creates extremely desirable light patterns being dispersed from fluorescent light source 12.

Figure 7:
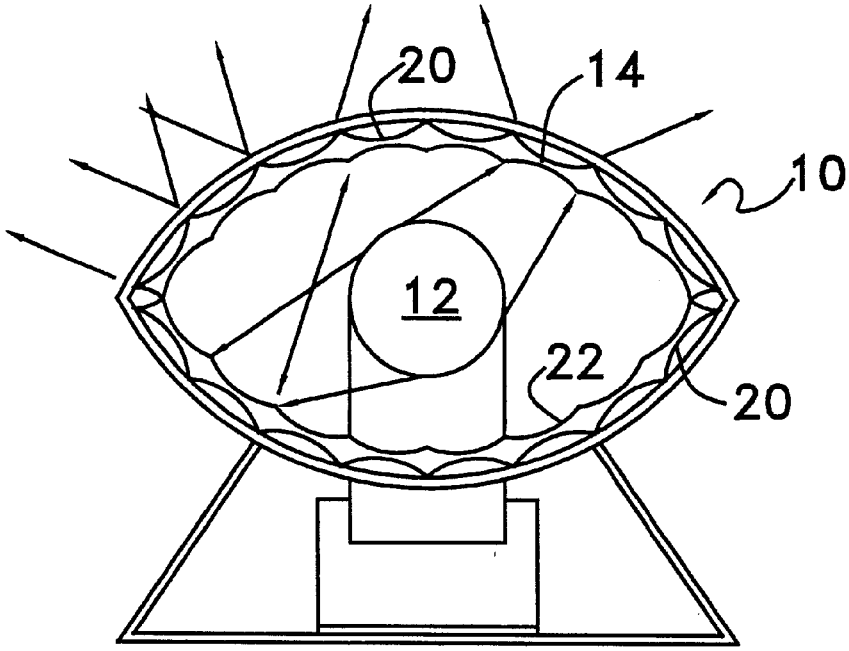
FIG. 7 is an end view of the lighting jacket of FIG. 3 illustrating the reflected and refracted light patterns.

Reference is now made to FIG. 7 which schematicalLy illustrates the directions (see arrows) of reflected and refracted beams as they are directed from the reflective and refractive portions of casing 14.

Figure 8:
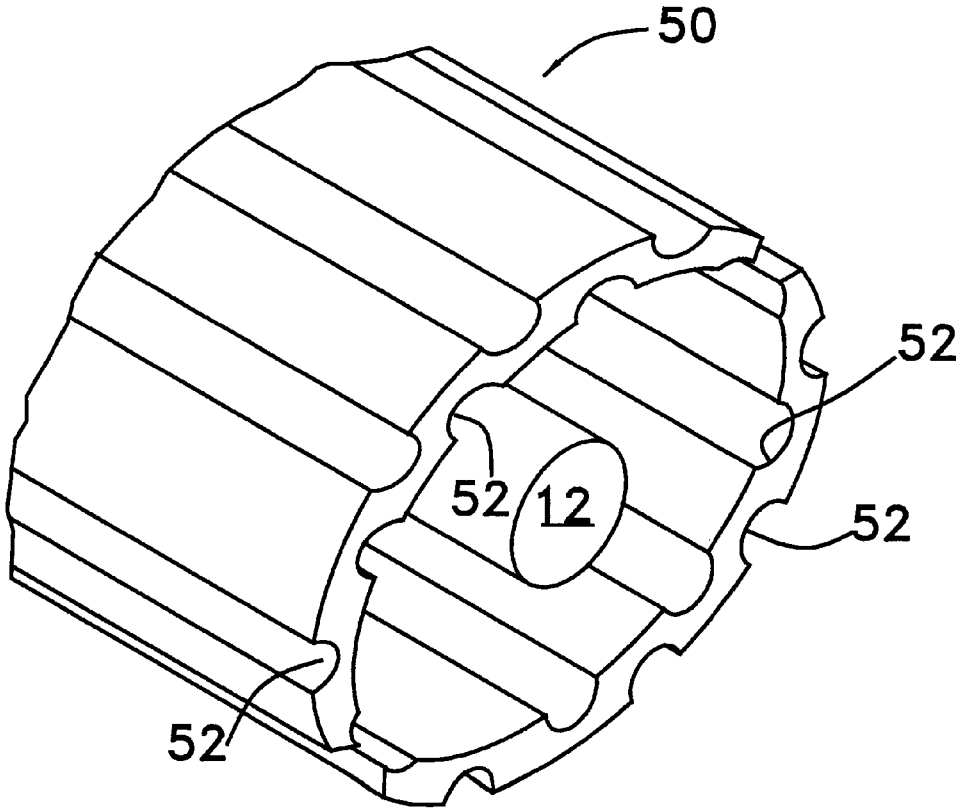
FIG. 8 is a further embodiment of the lighting jacket of this invention.

Another embodiment of the present invention is illustrated in FIG. 8 wherein casing 50 is designed such that the flutes of maximum concavity 52 are alternately dispersed about the interior and exterior of casing 50. This pattern of alternately disposed flutes 52 may also be designed in increments of 15°, although it should be realized that this angular relationship can vary within the scope of the present invention.

Figure 9:
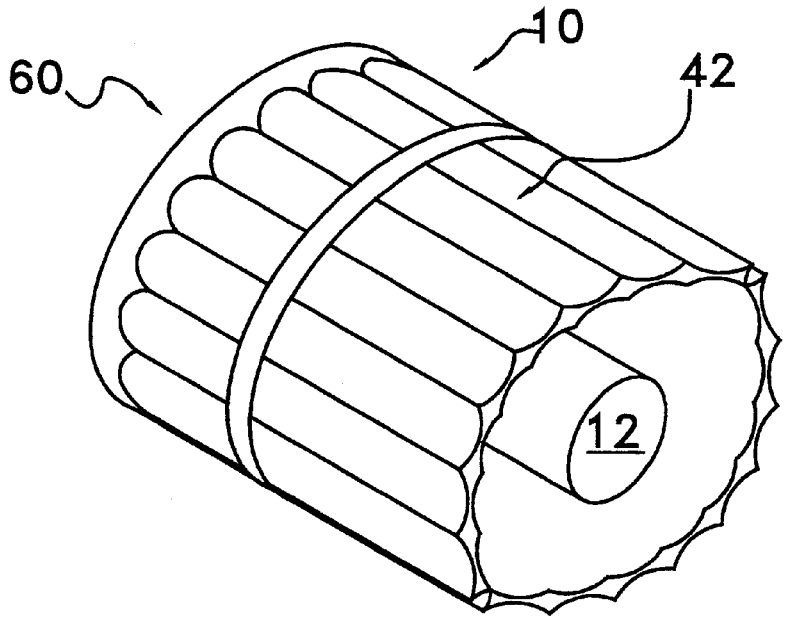
FIG. 9 is a pictorial representation of the lighting jacket of this invention having an end cap in place which permits the linkage of adjacent fixtures.
Figure 10:
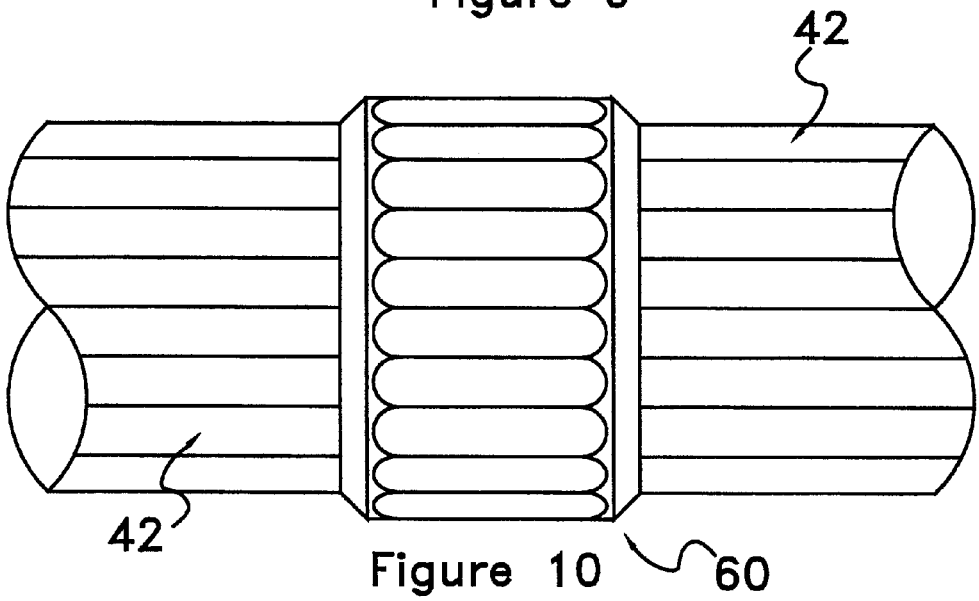
FIG. 10 is a plan view of a pair of lighting jackets of the present invention linked together.
Figure 11:
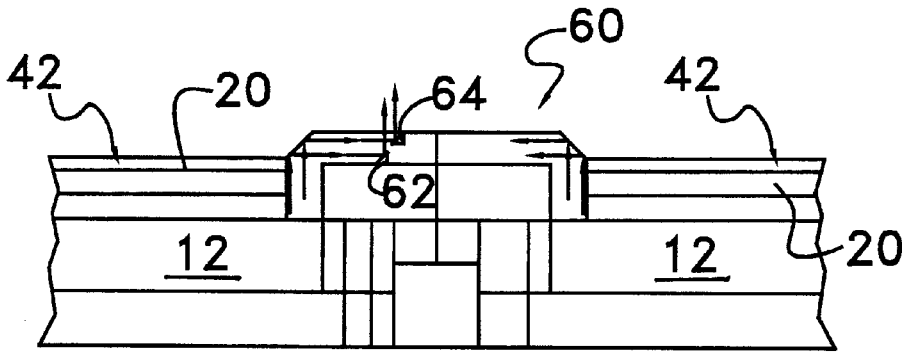
FIG. 11 is a cross-sectional side elevational view of FIG. 9.
Figure 12:
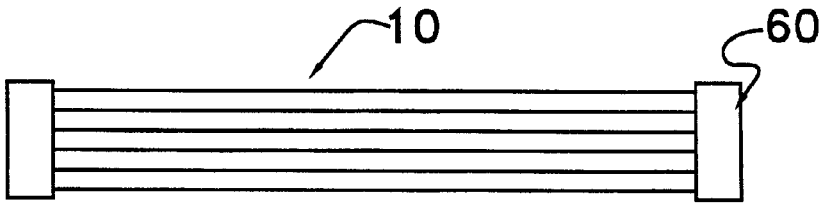
FIGS. 12–15 are schematic representations of a variety of linked configurations of the lighting jackets of this invention.

Reference is now made to FIGS. 9–11 which illustrate an end cap 60 capable of providing a linkage system for interconnecting jackets 10 of the present invention. The end cap/linkage system shown in the above Figures enable the jackets 10 to be brought together so as to give the illusion that the fixture (jacket 10) is continuously luminescent and gives the appearance of no "black spots." The end cap 60 may be made of a molded Plexiglas or polycarbonate.

Figure 13:
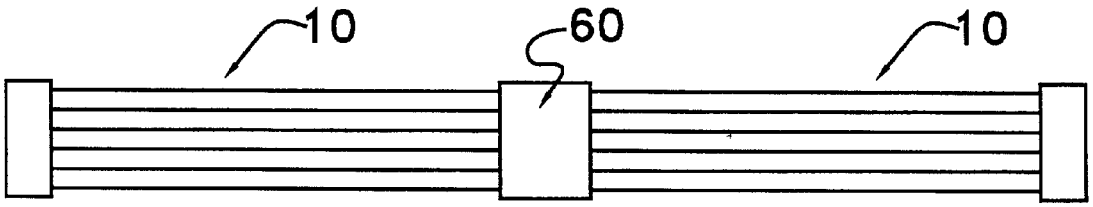
Figure 14:
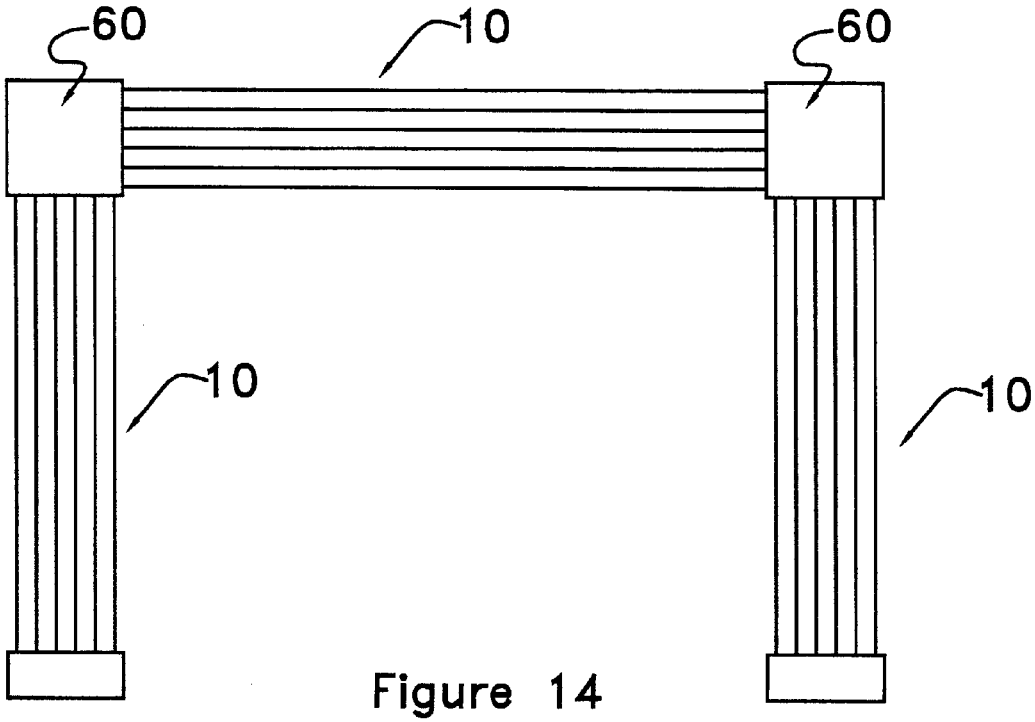
Figure 15:
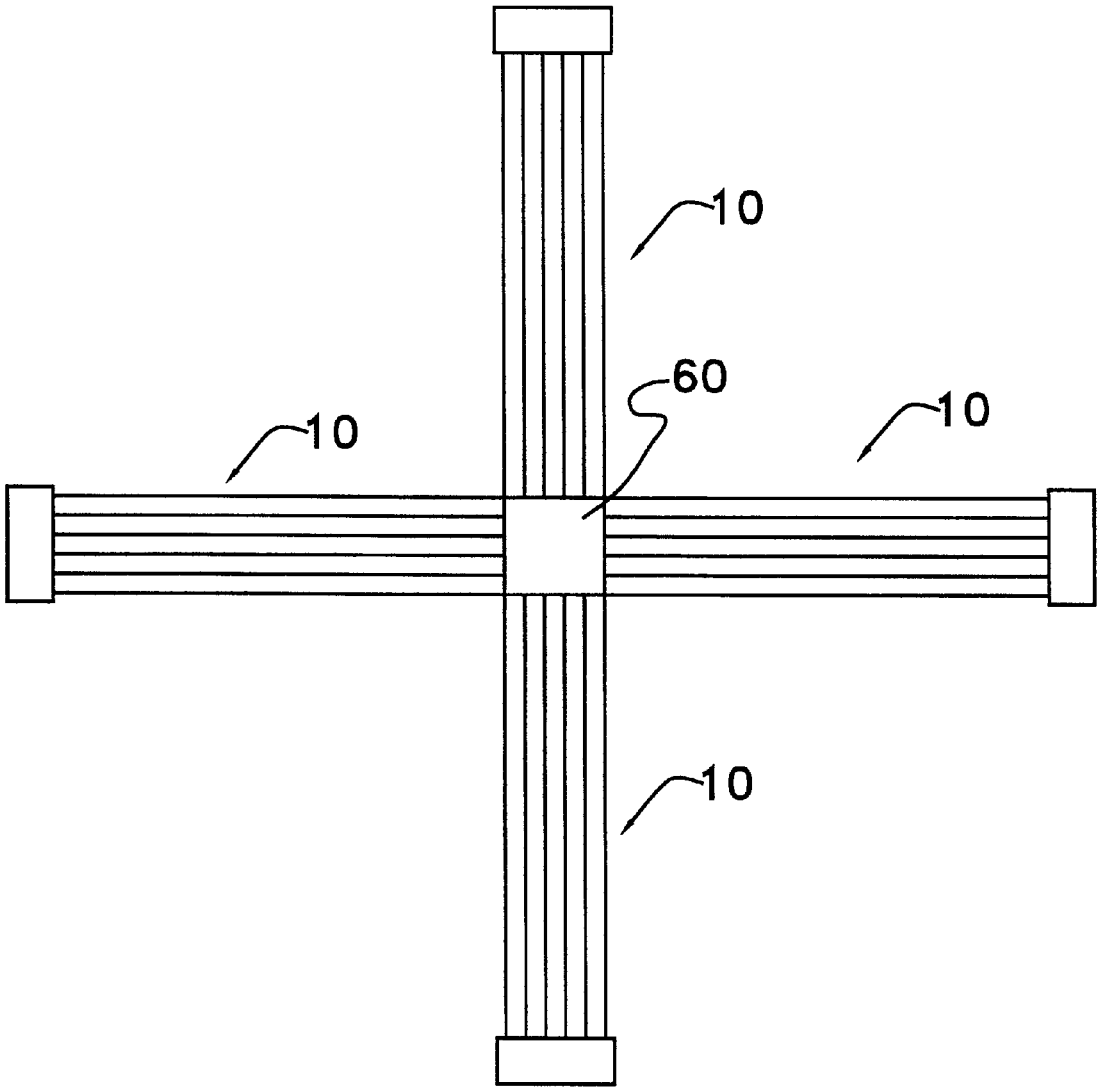

As shown in FIGS. 10 and 11, two casings 42 are interconnected by end cap 60. The end cap as shown in FIG. 11 may be transparent with a series of mirrors or reflective surfaces 62 and 64 thereby providing a light bridge between casings 14. Examples of a single jacket 10 with end caps 60 is shown in FIG. 11 while the remaining FIGS. 13–15 show various other linkages provided by the end cap/casing arrangement of the present invention.

Although the invention has been described with reference to particular embodiments, it will be understood that this invention is also capable of further and other embodiments within the spirit and scope of this invention.

What is claimed as new and desired to be secured by Letters Patent of the United States is:

1. A refractive-reflective lighting jacket for surrounding a lineal bulb light source extending in a longitudinal direction within an interior of said jacket, said jacket being comprised of a first reflective segment and a second refractive segment, each segment being of a shape in cross section associated with a focal point, the focal point of each said segment being located in the interior of the jacket, said segments each being fluted for reshaping light transmitted from the source.

2. A lighting jacket according to claim 1 wherein the segments are formed and placed such that the focal point associated with each segment lies within said bulb.

3. A lighting jacket according to claim 1 wherein said first and second segments are mounted so that their respective associated focal points coincide.

4. A lighting jacket according to claim 1 wherein said second segment comprises flutes on both interior and exterior surfaces and wherein an inner flute and an outer flute define a refractor having a negative focal length.

5. A lighting jacket according to claim 4 wherein said second segment is made of extrudable material of a selected thickness and wherein dimensions of the interior and exterior flutes are selected to provide the maximum negative focal length while not preventing extrudability of the material.

6. A lighting jacket according to claim 5 wherein a reflecting surface of said first segment is specular.

7. A lighting jacket according to claim 6 wherein said jacket further comprises end caps closing the interior of the jacket adjacent opposite longitudinal ends of the source and comprising reflecting surfaces disposed substantially normal to the longitudinal direction.

8. A lighting jacket according to claim 6 wherein the interior surface of said jacket includes patterns comprising specular reflectors.

9. A lighting jacket according to claim 1 wherein a reflecting surface of said first segment is specular.

10. A lighting jacket according to claim 1 wherein cross sections of said first and second segments are respectively defined as arcs of first and second circles each having its center on the other arc and wherein a focal point of each arc is intermediate the first and second arcs.

11. A refractive-reflective lighting jacket for surrounding a lineal bulb light source extending in a longitudinal direction within an interior of said jacket, said jacket being comprised of a first reflective segment and a second refractive segment, each segment being of a shape in cross section associated with a focal point, the focal point of each said segment being located in the interior of the jacket, said segments each being fluted for reshaping light transmitted from the source and end caps closing the interior of the jacket adjacent opposite longitudinal ends of the source and comprising reflecting surfaces disposed substantially normal to the longitudinal direction.

12. A lighting jacket according to claim 1 wherein said flutes on said second refractive segment are formed with selected curvature to provide substantially altered images of the lineal bulb as well as the reflections of the bulb on the flutes of the first reflective segment.

13. A lighting jacket system comprising a plurality of lighting jackets according to claim 1 and further comprises a refractive light-transmitting end cap for linking one said lighting jacket to a next said lighting jacket.

* * * * *